US005544602A

United States Patent [19]

Kawasaki

[11] Patent Number: 5,544,602

[45] Date of Patent: Aug. 13, 1996

[54] AUTOMATED SEWING DEVICE

[75] Inventor: Kiyoshi Kawasaki, Akishima, Japan

[73] Assignee: Tachi-S Co., Ltd., Tokyo, Japan

[21] Appl. No.: 294,831

[22] Filed: Aug. 29, 1994

[51] Int. Cl.[6] ..... D05B 21/00

[52] U.S. Cl. ..... 112/470.09; 112/470.18; 112/148; 112/308

[58] Field of Search ..... 112/470.09, 470.18, 112/470.14, 470.27, 308, 309, 153, 148

[56] References Cited

U.S. PATENT DOCUMENTS 4,928,609 5/1990 Kawasaki ..... 112/470.09

5,396,854 3/1995 Noqueras ..... 112/470.18

*Primary Examiner*—Peter Nerbun

*Attorney, Agent, or Firm*—Browdy and Neimark

[57] ABSTRACT

An automated sewing device for sewing at least one base material with two curved corner portions, which includes a sewing machine, a base guide plate and a movable guide plate. The movable guide plate has three guide rollers, each being respectively disposed at the apexes of an equilateral triangle, in the reverse side thereof, and the movable guide plate is formed with a plurality of guide grooves in such a pattern that describes three loci respectively of the three guide rollers required to cause proper displacements of the movable guide plate for guiding at least one side of the base material including the two curved corner portions in a direction to the sewing needle of the sewing machine. With such arrangement, the base material is automatically fed and sewn by the feeding and sewing force of the sewing machine, insuring to precisely sew each of the two curved corner portions of base material along the curvature thereof.

17 Claims, 8 Drawing Sheets

AUTOMATED SEWING DEVICE

BACKGROUND OF INVENTION

1. Field of the Invention

The present invention relates to an automated sewing device for sewing automatically base cloth or cover materials together into a trim cover assembly used on an automotive seat. More specifically, the present invention is directed to an automated sewing device capable of sewing together, automatically, particular shaped base cover materials having curved portions into one trim cover assembly, wherein the trim cover assembly is of a three-layer lamination type comprising a top cover member, a slab foam wadding member (made of urethane foam material) and a back cloth (or wadding cover).

2. Description of Prior Art

In general, a seat back or seat cushion forming an automotive seat is formed substantially in a rectangular shape, including a pair of forward curved or arcuate corners. In most cases, each of those two curved or arcuate forward corners has approx. 10 cm radius of curvature.

Thus, a process in the seat assemblage involves the steps of preparing the following two typical base cover materials: a central-cover-section base cover material having a pair of forward curved corner portions, each having the same 10-cm radius of curvature with the above-noted one, and a substantially U-shaped side-cover-section base cover material which includes a pair of forward curved corner portions, each having a radius of curvature close to 10 cm, in order to form a particular trim cover assembly covering the foregoing kind of seat back or seat cushion. Accordingly, the central-cover-section base cover material is defined herein as a cenral cover section of a resulting seat cover assembly for covering the main upper surface of seat back or seat cushion, whereas the side-cover-section base cover material is defined herein as another peripheral cover section of the resulting seat cover assembly for covering lateral side surfaces of seat back or seat cushion.

Coventionally, this sort of trim cover assembly has been formed manually, using an ordinary sewing machine. In the sewing operation, an operator needs to laminate one sewing end portion of the side-cover-section base cover material, at a given margin (e.g. 10 mm), upon the mating sewing end portion of the central-cover-section base cover material, to provide a sewing margin. Then, along the sewing margin, the operator uses his or her eyes and hands to manually guide the two base cover materials towards the sewing needle of sewing machine, while moving one of the two base cover material, i.e. the central-cover-section base cover material, in appropriate directions, so that the mated ends of both two base cover materials may be sewn together along a predetermined outer configuration of seat cushion or seat back. But, this manual process requires a long-experienced, high expertise on the operator's part and does not guarantee to form all satisfied sewn trim cover assembly in constant way.

Recently, an automated sewing machine has been proposed in an attempt to solve the foregoing problems, such as the one disclosed in the Japanese U.M. Laid-Open Pub. No. 54-72966. According thereto, an automated sewing machine is disclosed, which is capable of sewing automatically the end of three layer lamination of base cover materials. The sewing machine includes a lower guide plate on which the three base cover materials are placed, and an upper guide plate having, provided thereon, a guide rail extending along the peripheral end thereof, the guide rail having a guide groove defined therein. The guide plate is slidably movable on the table of sewing machine. The sewing machine further includes a guide roller disposed just above the sewing needle, which is rotatably fitted in such guide groove on the upper guide plate. With this structure, the three base materials are sandwiched securely between the upper and lower guide plates, and then operation of the sewing machine causes the thus-secured base materials to be automatically fed towards the sewing needle, while simultaneously causing movement of both guide plates along the guide rail, whereby the sewing is effected to and along the peripheral end of the base materials.

However, in this prior art structure, the two base cover materials are guided by the two points; namely, the feeder of sewing machine and the engagement point where the guide roller is rotatably engaged in the guide rail. This certainly permits precise locating of the base cover materials with respect to the sewing needled, but when sewing a curved portion of the base materials, a simple guide roller and rail mechanism does not precisely guide the curved portions of base materials toward the sewing needle in a direction of tangent touching on the curvature of such curved portions. Consequently, the curved portions of base cover materials are not sewn correctly and the resulting sewn cover member shows a poor seam at its curved portion or corner.

SUMMARY OF THE INVENTION

In view of the above-stated drawbacks, it is therefore a primary purpose of the present invention to provide an improved automated sewing device which permits a base material with two curved corner portions to be sewn along the peripheral sides thereof, automatically, with precision.

To attain such purpose, the present invention basically comprises:

a sewing machine including a sewing needle and feeding member;

a movable guide means having a shape generally similar to that of the base material, upon which movable guide means, the base material is to be secured;

the movable guide means being provided, on a reverse side thereof, with a first guide roller, a second guide roller and a third guide roller, in such a manner that the first and second guide rollers are respectively disposed at one point corresponding to a center of curvature of one curved corner portion of the base material and at another point corresponding to a center of curvature of another curved corner portion of the same base material, and further that all the first, second and third guide rollers are disposed at three apexes of an equilateral triangle, respectively; and a base guide plate means in which a plurality of guide grooves are formed in such a pattern that describes three loci respectively of the first, second and third guide rollers required to cause proper displacements of the movable guide means for guiding at least one side of the base material including the two curved corner portions in a direction to the sewing needle of the sewing machine, wherein, upon the base guide plate, the movable guide means is movably mounted, with the first, second and third guide rollers being slidably fitted in the guide grooves.

Accordingly, the foregoing at least one side of base material can be automatically fed and sewn by the sewing machine, with the movable guide means being displaced under guidance of the first, second and third guide rollers which follow the respective three loci. Hence, the base material is stably supported at three points in such triangular guide roller arrangement, thereby insuring to sew those particular curved corner portions of the base material in the tangential direction, with a great precision. Further, there is no need to prepare a special feeder for feeding both moveable guide means and base material, which contributes to a low-cost and simple structure of the present sewing device.

Another purpose of the present invention is to facilitate the change of direction of the first and second guide rollers at their respective acutely curved groove areas in the guide grooves.

For that purpose, in accordance with the present invention, there are provided first and second auxiliary guide roller means, each preferably comprising an auxiliary guide roller and a cylinder, wherein operation of the cylinder causes movement of the guide roller to push one of the first and second guide rollers at its acutely curved groove areas, helping thus to allow the same to smoothly change its direction there. Preferably, to actuate each of those two auxiliary guide roller means automatically, a sensor means may be provided at proper points in the guide groove in which the third guide roller follows at the point of time when one of the first and second guide rollers follows its acutely curved groove area.

Preferably, in addition to such two auxiliary guide roller means, a speed control means may be arranged in the present sewing device, such as to automatically decrease the sewing or feeding speed of sewing machine during the time when one of the first and second guide rollers reaches its acutely curved groove area, or when one of the curved corner portions of base material is sewn.

Preferably, the guide grooves may be of a pattern which includes generally straight groove areas, curved groove areas and generally circular groove areas, which are formed in conformity with the three loci respectively of said first, second and third guide rollers required to cause proper displacements of the movable guide means for guiding said at least one side of the base material including the first and second curved corner portions in a direction to the sewing needle of sewing machine, such that the first, second and third guide rollers may follow the generally straight groove areas to cause a generally straight side portion of the base material to be sewn by the sewing needle along a sewing direction thereof, and then one of the first and second guide rollers may follow the curved groove areas in cooperation with the third guide roller following the generally circular groove areas so as to cause one of the two curved corner portions of the base material to be sewn by the sewing needle along a curvature thereof, after which, another of the first and second guide rollers may follow the curved groove areas in cooperation with the third guide roller following the generally circular groove areas so as to cause another of the two corner portions of the base material to be sewn by the sewing needle along a curvature thereof.

More preferably, the foregoing guide groove pattern may be so arranged that both curved and generally circular groove areas are defined centrally of the movable guide means, such that the circular groove areas are disposed inwardly of the curved groove areas, and the straight groove areas are defined on opposite sides of those curved and generally circular groove areas, so that the first, second and third guide rollers may follow the straight groove areas along their respective locuses to cause sewing of the generally straight side portion of the base material, at each of sewing start and sewing end points on the movable guide means, and that the first and second guide rollers may follow the curved groove areas along their respective said loci, while the third guide roller may follow the generally circular groove areas along the locus thereof, without interference among those three guide rollers, to cause each of the first and second curved corner portions of the base material to be sewn along the curvature thereof by the sewing needle.

Yet more preferably, in the foregoing patterns of guide grooves, the generally straight groove areas include a common groove portion disposed near the sewing needle, while the curved groove areas include first and second curved groove portions which are distant from the sewing needle and disposed generally in a symmetrical relation with each other relative to the sewing needle, the arrangement of those common, first and second curved groove portions being such that when sewing the first curved corner portion of the base material, the second and third guide rollers are displaced in a generally arcuate way with respect to the first guide roller being positioned at the common groove portion, thereby causing the first curved corner portion to be sewn by the sewing needle in a direction of tangent touching on the curvature of the first curved corner portion, and that when sewing the second curved corner portion of the base material, the first and third guide rollers are also displaced in a generally arcuate way with respect to the second guide roller being positioned at the common groove portion, thereby causing the second curved corner portion to be sewn by said sewing needle in a direction of tangent touching on the curvature of the second curved corner portion.

In one aspect of the invention, the movable guide means is provided, at an upper surface thereof, with a securing means for locating and removably securing the base material upon the movable guide means, and the securing means comprises a peripheral securing element disposed along a peripheral side of the movable guide means, and a securing needle disposed generally centrally of the movable guide means.

In another aspect of the invention, the movable guide means is a movable guide plate formed in a shape generally similar to that of said base material, which is provided, at a reverse surface thereof, with the first, second and third guide rollers, and further provided, at an upper surface thereof, with a securing means for securing the base material thereon, said movable guide plate having at least one side which includes two curved corner portions generally similar to those of such at least one side of said base material, wherein such at least one side of the base material is to be located and secured on the foregoing at least one side of said movable guide plate via the securing means, and wherein the base guide plate means includes a location wall erected at one end side thereof, the location wall being formed in a shape generally similar to the foregoing at least one side of the movable guide plate, so that the movable guide plate may be set on the base guide plate in reference to the location wall and thereafter, the base material may be precisely located in a given position upon the base guide plate by bringing said at least one side of the base material to contact and alignment with the location wall.

In yet another aspect of the invention, a stationary guide plate is provided above the movable guide means, so that another base material may be introduced on the stationary guide plate towards the sewing machine, and then a part of such another base material may be sewn with and along the foregoing at least one side of said first base material which is secured on said movable guide means.

Other various features and advantages of the invention will become apparent from reading of descriptions hereinafter, with reference to the drawings.

DETAILED DESCRIPTION OF PREFERRED EMBODIMENT OF INVENTION

Figure 1:
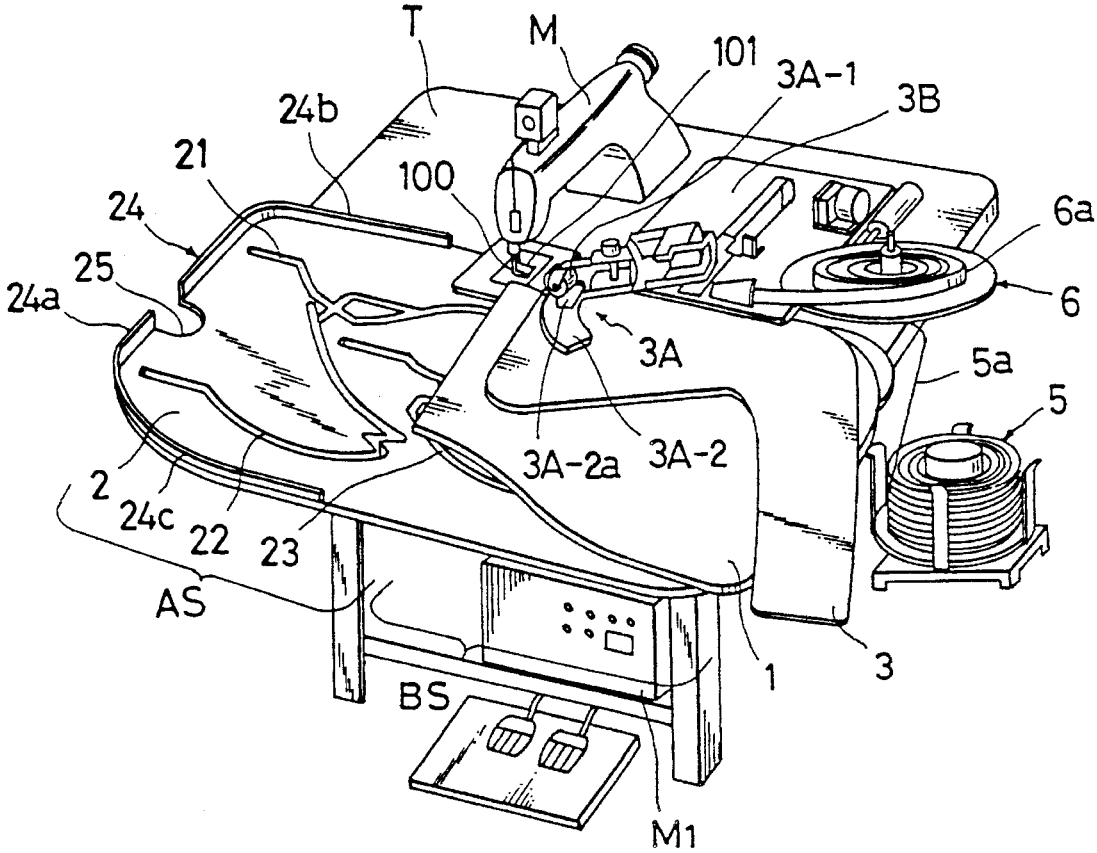
FIG. 1 is a schematic perspective view of an automated sewing device in accordance with the present invention.

Referring to FIG. 1, there is generally shown an automated sewing device in accordance with the present invention.

Designation (M) denotes a main sewing machine which is electrically connected with a computerized control section (M1), and thus, the main sewing machine (M) may be driven and stopped through operation of the control section (M1).

Fixedly mounted on the table (T) of the sewing machine (M) is a guide base plate (2) which has a particular pattern of guide grooves formed in the upper surface thereof, the grooves being basically comprised of a first guide groove (21), a second guide groove (22) and a third guide groove (23), as can be seen from FIG. 1, which will however be described in details later.

A movable guide plate (1) is movably mounted on the guide base plate (2). As will be described later, the movable guide plate (1) is provided on its reverse side with three guide rollers (11)(12)(13) which are respectively supported rotatably by disc support brackets (11A) (12A) (13A) (See FIGS. 3 and 4), in a manner that guide rollers (11)(12) (13) are respectively rotatably fitted in the foregoing three guide grooves (21)(23)(22). Hence, the guide plate (1) may be moved in predetermined directions along the three guide grooves (21)(23)(22), which will also be explained in greater details later.

Designation (3) denotes a stationary guide plate disposed at a level above the movable guide plate (2) set on the guide base plate (1). The stationary guide plate (3) is provided with an auxiliary guide device (3A) which includes a guide introductory plate (3A-2), a guide opening (3A-2*a*) formed in the guide introductory plate (3A-2), and a roller (3A-1) movable vertically to permit its contact with the surface of stationary guide plate (3) through the guide opening (3A-2*a*).

Generally designated by (5) and (6) is a device for fixing a decorative beading to a sewn line which is formed by using the present sewing machine to sew together base cover materials mentioned below. In brief, the core wire (5*a*) set in a basket (5) is fed with a tape of beading cover (5*a*) by means of rotary feeding device (6) towards the sewing needle (100) of main sewing machine (M), so that a unit of resulting combined core wire (5*a*) and beading cover (6*a*) is sewn, as decorative beading, with the undermentioned two base cover materials, at one time, along a seam. But, this is not the principal part of the present invention and any further explanation thereon is deleted for the sake of simplicity in description.

Figure 2:
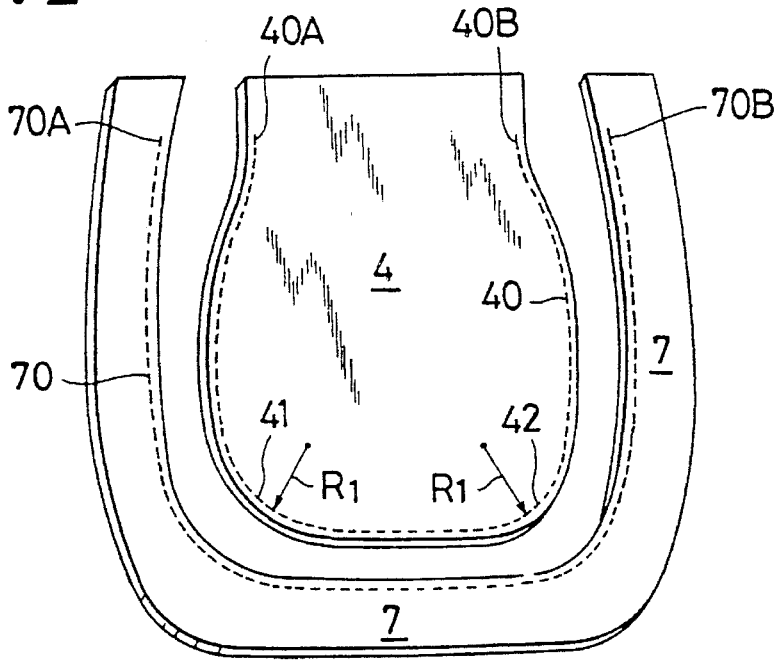
FIG. 2 is a schematic perspective view of first and second base cover materials to be sewn together by the automated sewing device.

The illustrated sewing device is designed to automatically sew together two typical base cover materials into one trim cover assembly for covering a seat cushion of an automotive seat. But, the present invention is not limited thereto, and the sewing device may be used for sewing the peripheral end portions of one base cover material. Here, the two typical base cover materials refer to a central-cover-section cover material (4) and a side-cover-section cover material (7), respectively, as shown in FIG. 2. As previously stated in the description of prior art, the central-cover-section and side-cover-section cover materials (4)(7) are for covering the main upper surface of seat cushion and the lateral vertical surface of the same, respectively. (see FIG. 17)

Hereinafter, the central-cover-section base cover material (4) shall be referred to as a "first cover material", and the side-cover-section base cover material (7) be referred to as a "second cover material".

As in FIG. 2, the first cover material (4) is of a generally square shape, having a pair of forward curved or arcuate corner portions (41)(42) formed in the forward side thereof. On the other hand, the second cover material (7) is of a generally U-shaped configuration, extending at a length equal to that of peripheral end portion of the first cover material, excepting the backward side of the same. Each of such two forward curved corner portions (41)(42) has a same radius of curvature (R1) (e.g. 10 cm), and thus the two curved corner portions of the second cover material (7) each has a slightly greater radius of curvature than that (R1) of the corresponding corner portions (41)(42) of first cover material (4).

Designations (40)(70) in FIG. 2 stand for a seam imaginarily indicated in both two cover materials (4)(7) for better understanding, but practically, it should be understood that the seam (40, 70) is one seam created by one sewing yarn of the sewing machine (M) which connects the two cover materials (4)(7) together, and therefore indicative of a sewing line along which the inward peripheral end of second cover material (7) is to be sewn and connected with the outward end of first cover material (4) through operation of the present sewing device. Also, designations (40A)(40B) respectively denote a sewing start point and a sewing end point, in the first cover material (4), whereas designations (70A)(70B) respectively denote sewing start and sewing end points in the second cover material (7).

Figure 3:
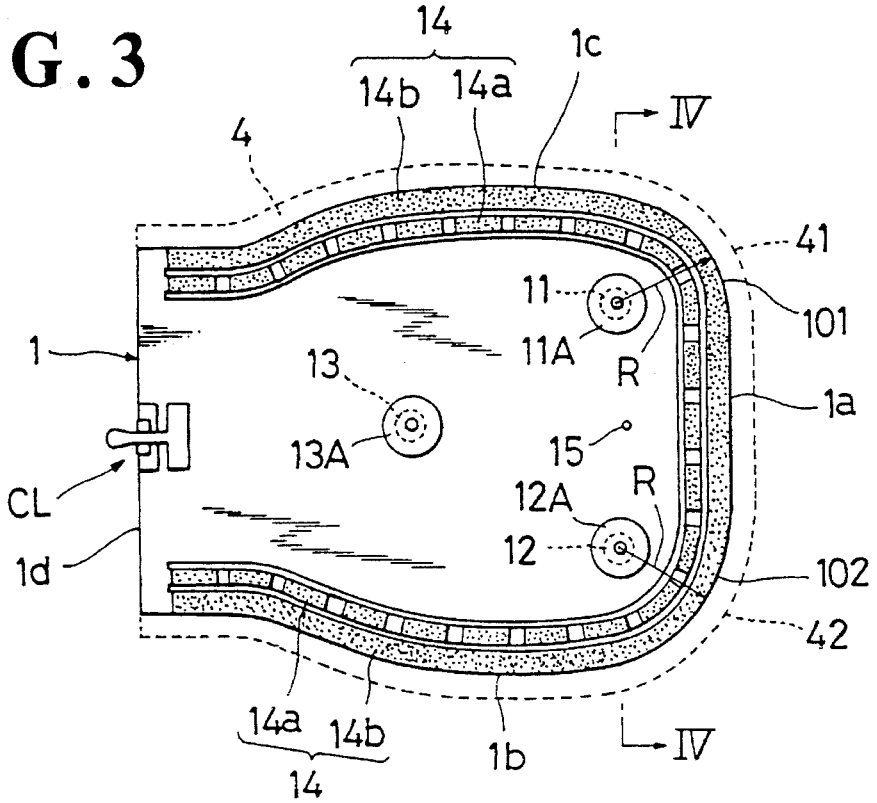
FIG. 3 is a plan view of a movable guide plate provided in the automated sewing device.
Figure 4:
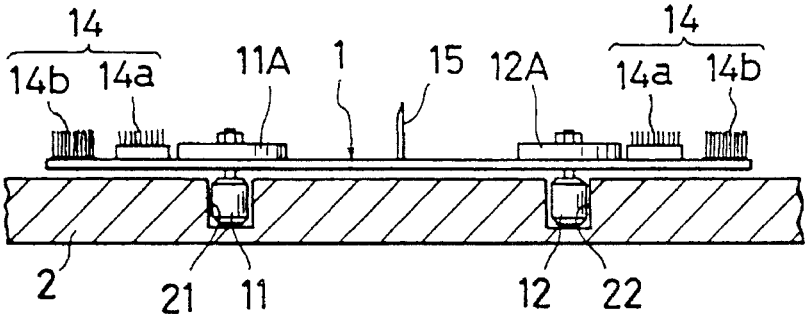
FIG. 4 is a sectional view taken along the line IV—IV in the FIG. 4.

FIGS. 3 and 4 illustrate the movable guide plate (1). This movable guide plate (1) is formed from a synthetic resin material in the shown shape similar to the outer shape of the foregoing first cover material (4), but smaller than the latter by a proper sewing margin (i.e. a margin to seam). This can be understood by comparing the phantom line of first cover material (4) with the outermost solid line of movable guide plate (1) in FIG. 3. The movable guide plate (1) has a pair of forward curved (or arcuate) corner portions (101)(102), each corresponding to the respective foregoing two curved corner portions (41)(42) of first cover material (4). But, for giving the sewing margin, each of the two curved corner portions (101) (102) of the movable guide plate (1) should have a slightly smaller radius of curvature (R) than that (R1) of the two curved corner portions (41) (42) of first cover material (4), as indicated in FIG. 3.

As seen in FIG. 1, the present sewing device is divided into a cover setting/sewing terminal section (AS) and a sewing start section (BS), both of which lies generally symmetrically relative to the sewing machine (M). As will be described later, the former section (AS) serves, at the initial stage, as a cover locating place where the first cover material (4) is to be located precisely and secured on the movable guide plate (1) at an initial operation stage, and further serves, at a final stage, as a sewing end point where the sewing is to be completed and the movable guide plate (1) be stopped. The latter section (BS) is a sewing start place where the movable guide plate (1) with the first cover material (4) secured thereon is to be set and subject to sewing operation for sewing the second cover material (7) to the first one (4).

As understandable from FIGS. 3 and 4, the movable guide plate (1) is provided, on the reverse side thereof, with the previously stated three rollers (11)(12)(13), in such a manner that those rollers (11)(12)(13) are disposed at the three points corresponding to three apexes of equilateral triangle. Further, the same guide plate (1) is provided, on the upper side thereof, with the following three means for securing the first cover material (4) thereupon: a peripheral securing member (14); a securing needle (15); and a clamp (CL). The peripheral securing member (14) comprises plural small strips of needle cloths (14*a*) with many thin needles erected thereon, and a tape of velvet-type fastener (14*b*) (the so-called magic tape). As shown, the velvet-type fastener tape (14*b*) is fixed on and along the three peripheral sides (1*c*)(1*a*)(1*b*) of movable guide plate (1), and the needle cloths (14*a*) are fixed inwardly of the same guide plate (1), extending abreast with that fastener tape (14*b*) in the same length. The securing needle (15) erects on a central point forwardly of the movable guide plate (1), while on the opposite sides thereto, the clamp (CL) is fixed on the backward side (1*d*) of movable guide plate (1). Using those securing elements, the first cover material can be precisely located and positively secured on the movable guide plate (1) against unexpected movement during the sewing operation.

Designation (24) in FIG. 1 denotes a cover location wall of a generally "U" shape which projects upright on and extends along the left-side peripheral end portion of the guide base plate (2), at the side of the cover setting/sewing terminal section (AS). The cover location wall (24) is used in conjunction with the movable guide plate (1) to locate the first cover material (4), precisely, with respect to the movable guide plate (1), as will be elaborated later.

Also, designation (25) in FIG. 1 denotes a generally U-shaped cut-away area formed in both left-side ends of the cover location wall (24) and guide base plate (21). Through this cut-away area (25), an operator can make his or her hand accessible to the movable guide plate (1) set on the left-side half region of guide base plate (2) to take off that guide plate (1) therefrom.

Figure 8:
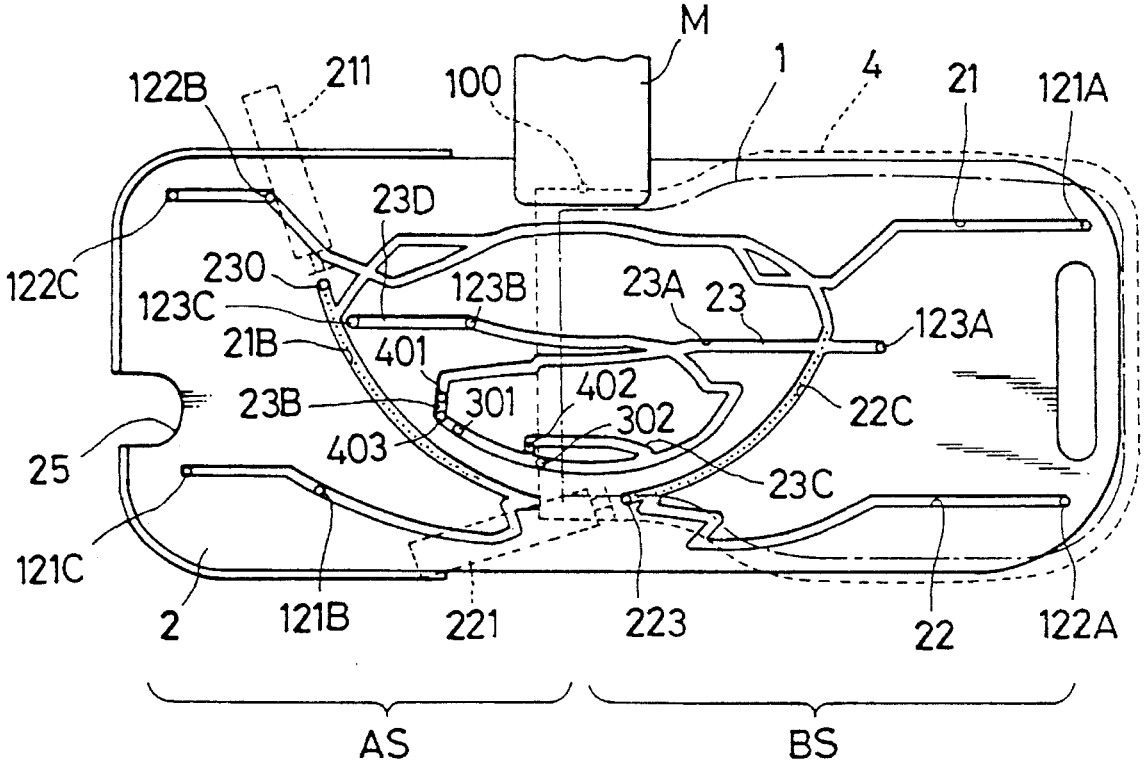
FIG. 8 is a partly broken, schematic plan view showing the base guide plate.

FIG. 8 shows a whole structure of guide base plate (2) on which a particular guide groove pattern is formed for guiding the three rollers (11)(12)(13) of movable guide plate (1) properly in order to permit automatic sewing of the second cover material (7) with the first cover material (4).

The guide groove pattern, in accordance with the present invention, is the one collectively formed by the three different guide grooves (21), (22) and (23). Designations (121A), (122A) and (123A) denote the respective guide start points of those three guide grooves (21), (22) and (23) which are defined on the right side of guide base plate (2) corresponding to the sewing start section (BS). Designations (122B), (121B) and (123B) denote the respective guide end points of the three guide grooves (21), (22) and (23) which are defined on the left side of guide base plate (2) corresponding to the cover setting/sewing terminal section (AS).

Figure 11:
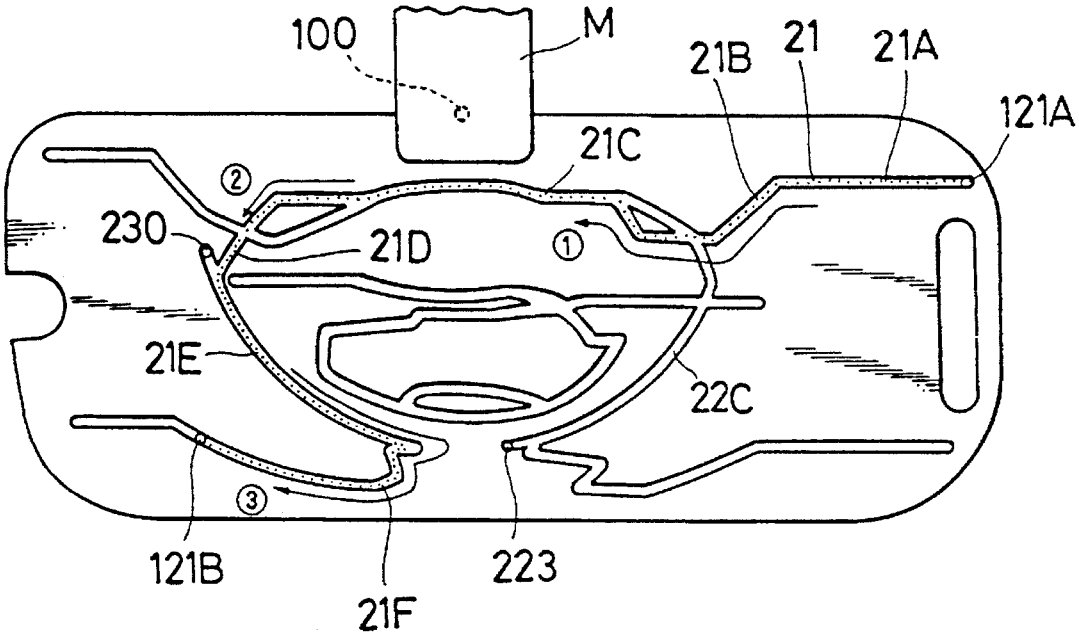
FIG. 11 is a schematic plan view indicating a first guide groove in the guide groove pattern.

Reference is now made to FIG. 11, wherein the first guide groove (21) is clarified by the dots. The illustrated meandering or winding irregular passage of the first guide groove (21) basically includes: a first straight groove area (21A) leading from the guide start point (121A); a second generally U-shaped curved groove area (21B) at the arrow (①); a third generally straight groove area (21C); a fourth generally inverted U-shaped curved groove area (21D), at the arrow (②); a fifth inwardly arcuate groove area (21E); and a sixth outwardly curved groove area (21F), at the arrow (③), which leads to the guide end point (121B). In operation, the corresponding first guide roller (11) of movable guide plate (1) follows those groove areas in the directions as indicated by the three arrows (①)(②)(③), from the guide start point (121A) to the guide end point (121B).

Figure 12:
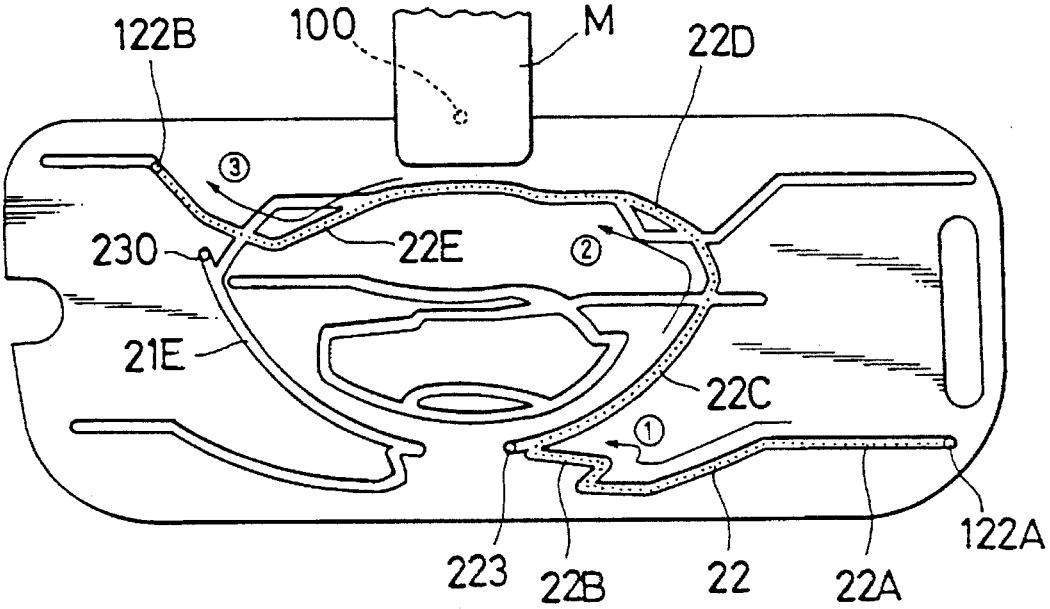
FIG. 12 is a schematic plan view indicating a second guide groove in the guide groove pattern.

Reference is made to FIG. 12, wherein the second guide groove (22) is clarified by the dots. The groove pattern shown therein is of a generally reversed shape as compared with the foregoing pattern of first guide groove (21), but includes the following different groove areas: a first straight groove area (22A) which is generally equal in length to the one (21A) of first guide groove (21) and extends in parallel therewith; a second zigzag groove area (22B), as seen at the arrow (①); a third outwardly arcuate groove area (22C) which extends generally in a symmetrical relation with the fifth arcuate groove area (21E) of the first guide groove (22) with respect to the central line of the guide base plate (2); a fourth generally inverted-U-shaped curved groove area (22D) which crosses the second U-shaped curved groove area (21B) of first guide groove (21) at two points; a common generally straight groove area which is the same groove area with the third groove area (21C) of first guide groove (21); and a fifth generally U-shaped curved groove area (22E) which crosses the the fourth inverted-U-shaped curved groove area (21D) at two points, as seen at the arrow (③). The fifth curved groove area (22E) leads to the guide end point (122B). In operation, the corresponding second guide roller (12) of movable guide plate (1) follows those several groove areas in the directions as indicated by the three arrows (①)(②)(③) from the guide start point (122A) to the guide end point (122B).

Figure 13:
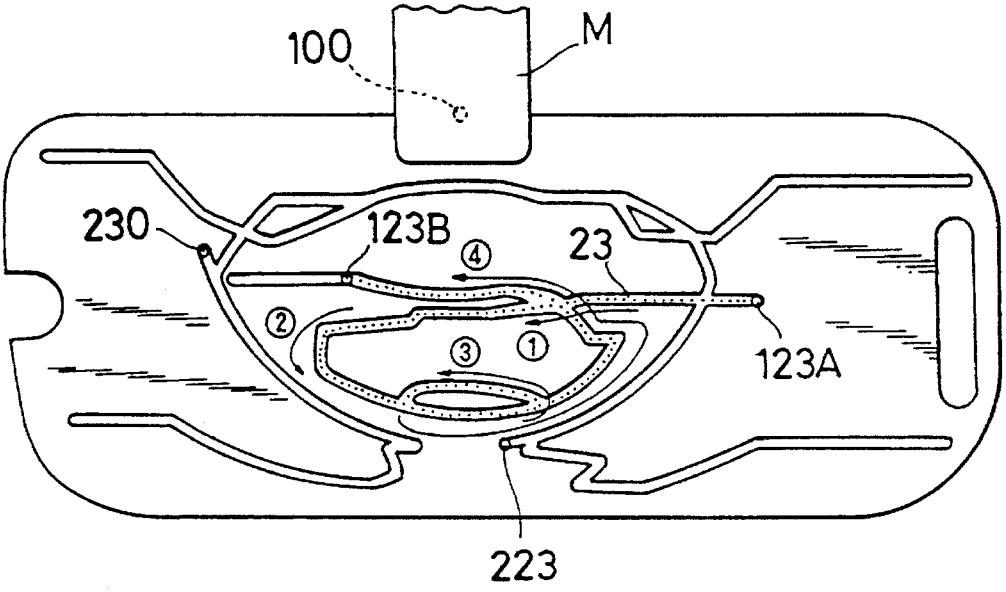
FIG. 13 is a schematic plan view indicating a third guide groove in the guide groove pattern.

Reference is further made to FIG. 13, wherein the third guide groove (23) is clarified by the dots. As can been seen from FIG. 3, a whole pattern of this guide groove (23) is generally of an inverted "Ω" shape and mostly surrounded by the central, circularly aggregated pattern portion of both first and second guide grooves (21)(22). The illustrated groove pattern is essentially required for permitting the corresponding third guide roller (13) to move in a non-interference cooperation with the movements of the first and second guide rollers (11)(12) along their respective guide grooves (21)(22), so as to insure smooth displacement of the movable guide plate (1) for sewing together the first and second cover materials (4)(7). Now, referring to FIG. 8 and FIG. 11, the guide pattern of third guide groove basically includes: a first straight groove area (23A) generally equal in length to the first straight groove area (21A) of first guide groove (21); a second generally circular groove area (23B); and a third groove area (23C) defined at the central curved part of second circular groove area (23B). The second circular groove area (23B) leads to the guide end point (123B). In operation, as indicated by the four arrows (①)(②)(③)(④) in FIG. 13, the corresponding third guide roller (13) follows those groove areas (23A)(23B) (23C) from the guide start point (123A) to the guide end point (123B).

The above-described particular patterns of first, second and third guide grooves (21)(22)(23) are formed in conformity with the respective three traces or loci of the first, second and third guide rollers (11)(12)(13) disposed respectively at the three equidistant apexes (of equilateral triangle).

Here, according to the present invention, the arrangement of those three guide rollers (11)(12)(13) is such that, referring again to FIG. 3, the first guide roller (11) is disposed adjacent to one curved corner portion (41) of movable guide plate (1) and at the center of circle along which that curved corner portion (41) extends, the circle thus having a radius corresponding to the rasius of curvature (R) of that particular curved corner portion (41), likewise, the second guide roller (12) is disposed at the center of circle along which another curved corner portion (42) extends, the circle therefore also having a radius corresponding to the same curvature radius (R) of that another corner portion (42), and that the third guide roller (13) is disposed at a point toward which two straight lines intersect, each extending at 60 degrees of inclination angle from those two centers of first and second guide rollers (11)(12), respectively.

We, the inventors, have found that such equilateral triangular arrangement of guide rollers (11)(12)(13) not only suffices to support stably the movable guide plate (1), but also only requires the two minimum movements: namely, a generally straight movement and a generally circular movement, in order to cause proper displacements of the movable guide plate (1) for automatical feeding of both first and second cover materials (4)(7) towards the sewing needle (100) of sewing machine (M), so that the two cover materials (4)(7) may be sewn together along the afore-stated seam (40 or 70) (see FIG. 2) which includes two curved corner portions (41)(42). Indeed, the three individual grooves (21)(22)(23) shown in FIGS. 11, 12 and 13 support such inventors' technical discovery, and this groove pattern is most effective in stably guiding the straight sewing margins of both first and second materials (4)(7) in a direction along the sewing direction (SD) of sewing machine (M) (see FIG. 14), and further stably orienting a tangent touching on either of the two curved corner portions (41)(42) of the first cover material (4) towards the sewing direction (SD) of sewing machine (M), as understandable from FIG. 14, for example.

Figure 9:
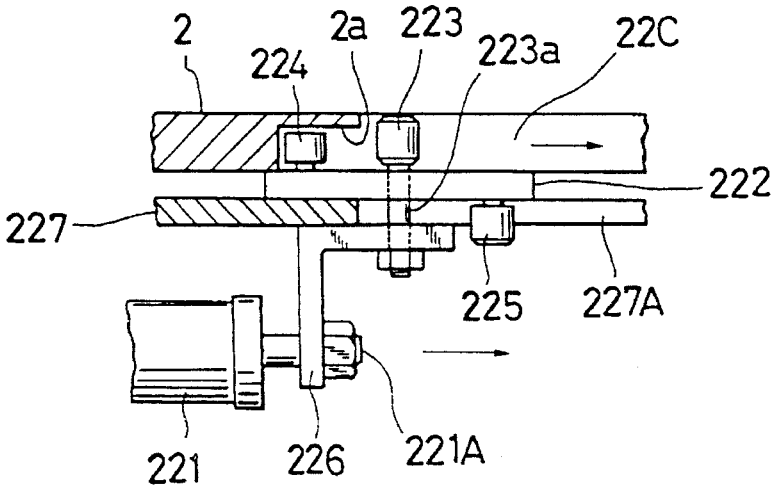
FIG. 9 is a partly broken sectional view of a part of the base guide plate and an auxiliary roller device.
Figure 10:
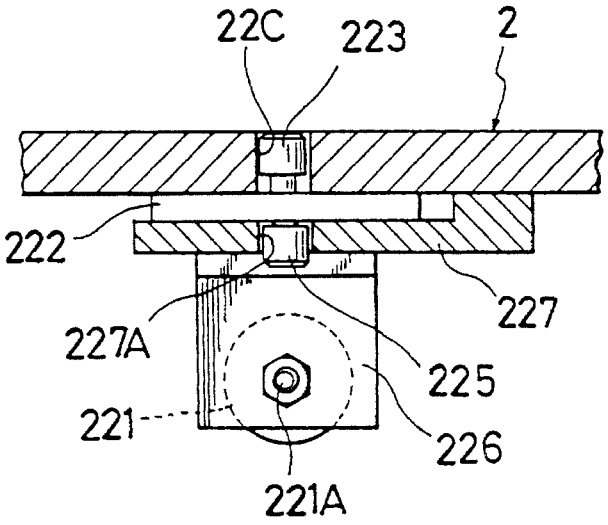
FIG. 10 is a partly broken sectional view of the same part of the base guide plate as in the FIG. 9 which is viewed from a different side thereof.

Referring to FIGS. 8, 9 and 10, the sewing device in the present invention is provided with an auxiliary means for facilitating smooth turning or directional changes of the first and second guide rollers (11)(12) at their respective acutely curved points where the rollers are most hard to turn or change their directions. As a preferred means serving that purpose, there are provided a first auxiliary roller device (230, 211) for the first guide roller (11), and a second auxiliary roller device (223, 221) for the second guide roller(12). Both first and second auxiliary roller devices are each basically comprised of an auxiliary roller assembly (at 230 or 223) and a cylinder (211 or 221), and of the same mechanical structure. With particular reference to FIG. 8, the cylinder (211) of the first auxiliary roller device is electrically connected with a first guide sensor (301) situated in the left-side curved part of second circular groove area (23B) of the third guide groove (23), whereas likewise, the cylinder (221) of the second auxiliary roller is electrically connected with a second guide sensor (302) situated in the central curved part of the same second groove area (23), adjacent to the left-side juncture of third curved groove area (23C). Upon one of the two sensors (301 or 302) detecting the third guide roller (13), it is turned on to energize the corresponding one of the cylinders (211 or 221) so as to to move forwardly the corresponding auxiliary roller assembly (at 230 or 223).

Now, a specific description will be made only in regard to the second auxiliary roller device (223, 221), for the sake of simplicity of description. As shown in FIGS. 9 and 10, the second auxiliary roller device comprises the afore-said cylinder (221) having a cylinder rod (221A), and an auxilliary roller assembly consisting essentially of: a generally inverted-L-shaped cross-section of guide rail member (227) which, as best seen in FIG. 10, has an upwardly extending part fixed to the reverse side of guide base plate (2) and a horizontally extending part, with a guide slit defined between the guide base plate reverse side and that horizontally extending part, wherein the horizontally extending part has an auxiliary guide groove (227A) perforated therein, which extends along and in parallel with the third curved groove area (22C) of second guide groove (22); a slide member (222) slidably fitted in the foregoing guide slit of the guide rail member (227); a main auxiliary roller (223) rotatably mounted on the upper end of a shaft (223*a*) fixed in the slide member (222), wherein the shaft (223*a*) penetrates through the slide member (222), passes through the auxiliary guide groove (227A) and terminates in a lower threaded end to which one end of a generally L-shaped bracket (226) is firmly connected by means of a nut, wherein another end of the bracket (226) is firmly connected to the piston rod (221A) of cylinder (221) by means of a nut; a lower sub roller (225) fixed to the reverse side of slide member (222), the lower sub roller (225) being rotatably fitted in the auxiliary guide groove (227A); and an upper sub roller (224) fixed on the upper side of slide member (22), the upper sub roller (224) being normally located, as shown, in a recessed portion (2*a*) formed in the reverse side of movable guide plate (2). The recessed portion (2*a*) communicates with the third curved groove area (22C) of second guide groove (22). The upper and lower sub rollers (224)(225) are disposed on the opposite sides of the main auxiliary roller (223). With this construction, operation of the cylinder (221) causes all the slider member (222), main auxiliary roller (223), upper and lower sub rollers (224)(225) to be moved forwardly in the arrow direction in FIG. 9 so as to push the corresponding second guide roller (12) along the third curved groove area (22*c*), as will be elaborated later. The same operation is to be made in the first auxiliary roller device (211, 230) for pushing the corresponding first guide roller (11) along the fifth curved groove area (21E) of first guide groove (21), which also will be elaborated later.

Designations (401) and (402) represent a first deceleration microswitch and a second deceleration microswitch, respectively. Both microswitches (401)(402) are electrically connected with the computerized control section (M1) for decreasing the feeding or sewing speed of the sewing machine (M), when the third guide roller (13) reaches and turned on each of those two microswitches. As viewed from FIG. 8, the first deceleration microswitch (401) is disposed at the left-side curved part of the second circular groove area (23B) of third guide groove (23) and situated before the above-stated first sensor (301), and the second deceleration microswitch (402) is disposed at the left-side end or juncture of third curved groove area (23*c*) which communicates with the central curved part of second circular groove area (23B).

Designation (403) in FIG. 8 stands for a sensor or microswitch for operation of the auxiliary guide device (3A). The sensor (403) is electrically connected with the auxiliary guide device (3A) via the control section (M1).

Now, a description will be made of specific operations of the above-constructed automated sewing device.

Figure 5:
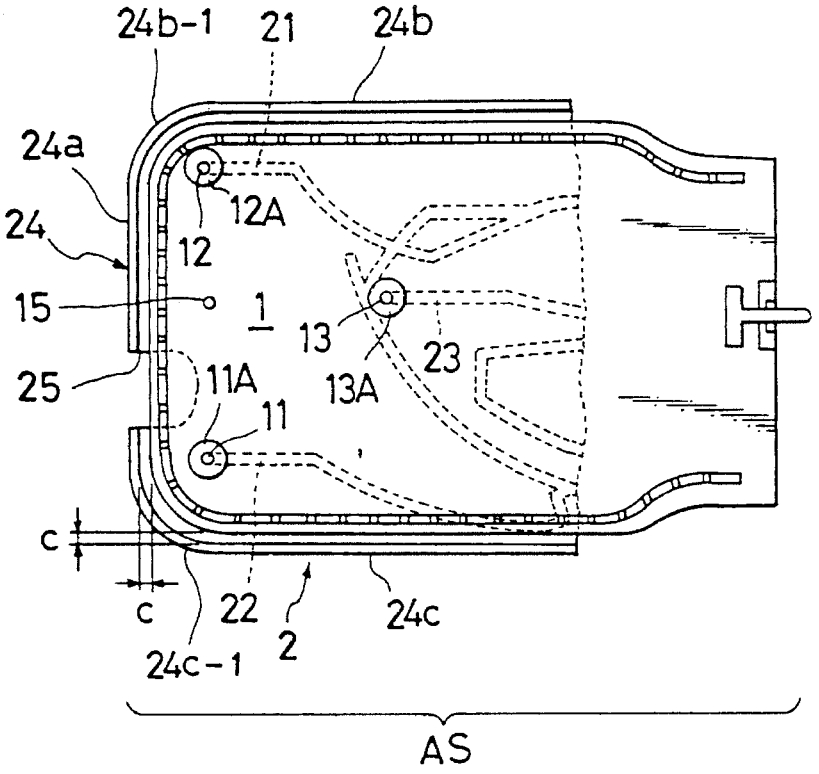
FIG. 5 is a schematic plan view showing the movable guide plate to be set on a base guide plate in a cover setting/sewing terminal section of the automated sewing device.

Firstly, as shown in FIG. 5, an operator should set the movable guide plate (1) on the left-side half cover-setting/sewing terminal section (AS) of guide base plate (2) by fitting the three guide (11)(12)(13) into their respective initial setting points (122C)(121C) (123C). As understandable from FIG. 8 and FIG. 5, the three initial setting points (122C) (121C)(123C) are defined in the respective terminal ends of the three guide grooves (21)(22)(23). Therefore, the movable guide plate (1) can be set at the three points and located precisely with respect to the location wall (24) of guide base plate (2), with a predetermined width of clearance (c) provided between the three peripheral sides (1*a*, 1*b*, and 1*c*. See FIG. 3) of the movable guide plate (1) and the three wall sections (24*a*, 24*b*, 24*c*) of the location wall. The clearances (c) have a given width corresponding to the aforementioned sewing margin (e.g. 10 mm) of both first and second cover materials (4)(7). It is noted that, for that reason, the location wall (24) should have two greater curved corner portions (24*b*-1)(24*c*-1), each having a proper greater radius of curvature than that (R) each of the corresponding two curved corner portions (101)(102) of movable guide plate (1) (see FIG. 3, thereby providing those clearances (c).

In the preset embodiment, though not shown, both first and second cover materials (4)(7) are each of a three-layer lamination type comprising a top cover layer (e.g. a leather), a foam padding layer (of urethane foam material) and a back cloth layer.

Figure 7:
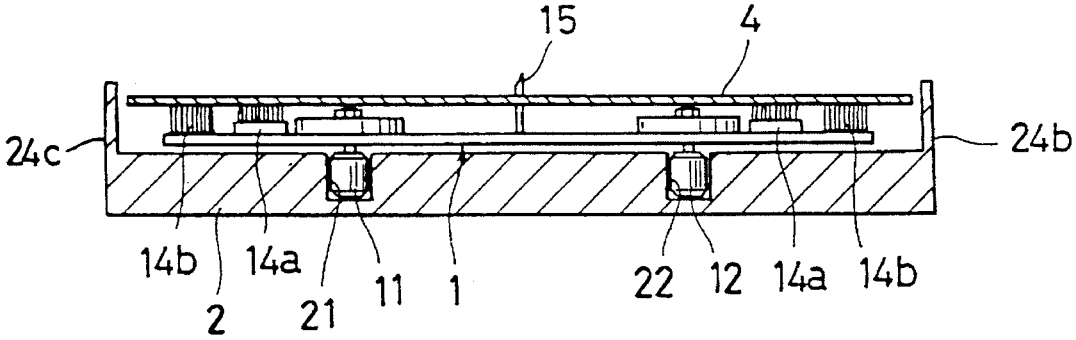
FIG. 7 is a sectional view taken along the line VII—VII in the FIG. 5.
Figure 6:
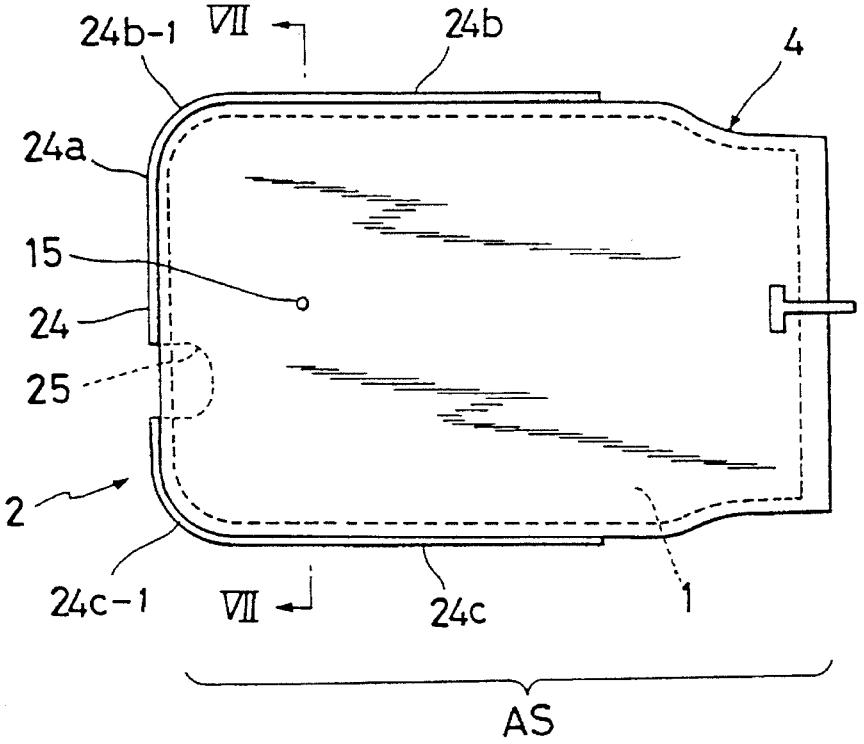
FIG. 6 is a schematic plan view showing the first cover material to be secured on the movable guide plate set on the base guide plate in the cover setting/sewing terminal section.

Secondly, the operator should take the first cover material (4), as it shows its top cover layer upwardly, then bring its forward central edge and two corner portions (41)(42) into contact and alignment with the inward wall surfaces of the corresponding three wall sections (24*a*) (24*b*-1)(24*c*-1) of location wall (24), and have the securing needle (15) of movable guide plate (1) pierced through that first cover material (4), then laying down the remaining part of same cover material (4) on the movable guide plate (1) as can be seen in FIG. 6. After being finally secured its backward end side by the clamp (CL), the first cover material (4) is precisely located in a given position upon the movable guide plate (1). Then, all the peripheral ends, excepting the backward end, of the first cover material (4) are removably secured to and along both needle needle cloths (14*a*) and velvet-type fastener (14*b*) of the movable guide plate (1), manually by the hands of the operator, thereby completing the provisional securement of first cover material (4) on the movable plate (1) as in FIG. 6 and 7.

Next, the operator should grasp, with his or her hand, the left-side end of the thus-combined unit of both first cover material and movable guide plate, though the cut-away area (24), as in FIG. 6, and take out it from the guide base plate (2).

The thus-removed movable guide plate (1) with the first cover material (4) secured thereon should then be brought towards the right-side sewing start section (BS) of the guide base plate (2), and set thereon by fitting the three guide rollers (11)(12)(13) into the start end points (121A)(122A)(123A), respectively, as indicated by the dot and one-dot chain lines in FIG. 8. At this moment, the sewing start point (40A) of first cove material (4) (see FIG. 2) is positioned just under the sewing needle (100) of sewing machine (M).

Then, the operator should take another second cover material (7), and place the same (which also shows its top cover layer upwardly) upon the stationary guide plate (3), passing one forward end portion of that second cover material (7) between the guide plate (3) and guide introductory plate (3A-2) of auxiliary guide device (3A) towards the sewing needle (100), and then juxtapose such one forward end portion of second cover material (7) upon the portion of first cover material (4) where its sewing start point (40A) exists, such as to coincide the sewing start point (40A) of second cover material (7) with that point (40A) within the given sewing margin.

Thereafter, operating the sewing machine (M) starts movements of its sewing needle (100) and feeding member (101) to automatically draw both first and second cover materials (4)(7) and sew then together, while the movable guide plate (1) is caused by the feeding force of sewing machine (100) to be moved along the three straight guide groove areas (21A)(22A)(23A).

Figure 14:
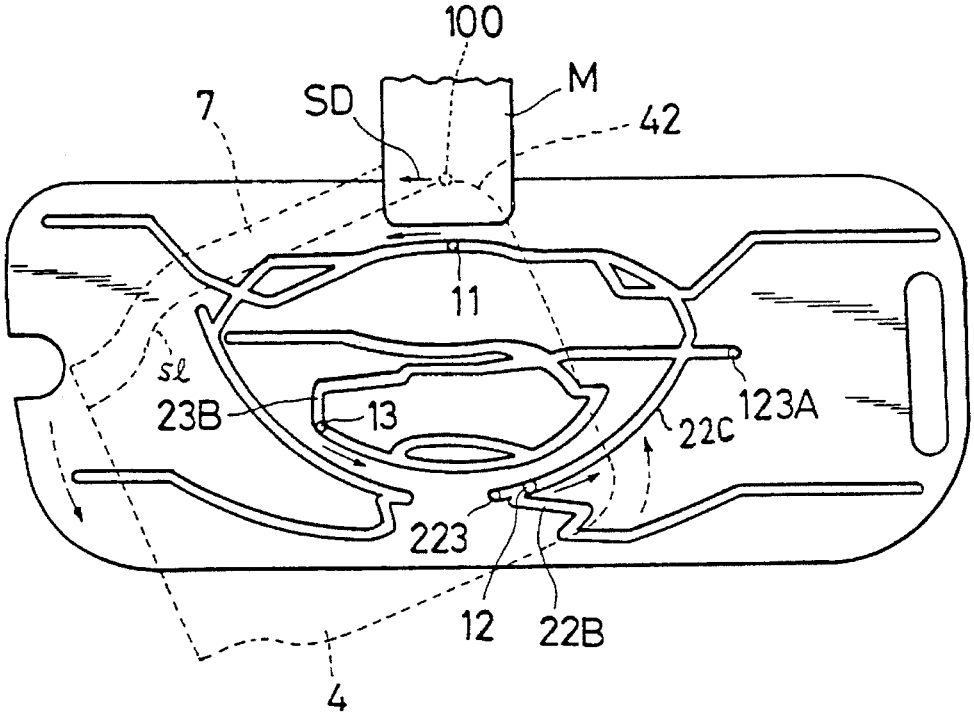
FIG. 14 is a diagram showing the displacements of both movable guide plate and three guide rollers for sewing one curved corner portion of the two cover materials.

FIG. 14 shows the state where one lateral side portion each of both first and second cover materials (4)(7) are sewn together. Although not shown, up to this sewing stage, the first and second guide rollers (11)(12) have passed along or followed their corresponding first straight groove areas (21A)(22A) and second curved groove areas (21B)(22B), while the third guide roller (13) has followed its corresponding first straight groove area (23A) and the gently curved part of the second circular groove area (23B) (which is, however strictly stated, of a generally elliptical shape as shown), to thereby cause proper displacement of the movable plate (1) for completing the sewing together of those first lateral side portions of both first and second cover materials (4)(7) which includes a gently curved, sloped area (sl), as understandable from the phantom lines in FIG. 14. But, the FIG. 14 itself also indicates that the second cover material (7) is about to be sewn along one curved corner portion (42) of first cover material (4). At this point, the first guide roller (11) follows the generally straight third groove area (21C), while the second guide roller (12) is positioned at the most acutely curved point or juncture between the second and third groove areas (22B)(22C), i.e. the point where the roller (12) is most difficult to turn or change its direction. However, since the third guide roller (13) passes the left-side curved part of the second circular or elliptical groove area (23B) during this hardest change of direction, the first deceleration microswitch (401) is turned "on" by that third guide roller (13) to decrease the sewing or feeding speed of sewing machine (M), thus allowing the second guide roller (12) to slowly enter the third groove area (22C) from the second groove area (22B), soon after which, the third guide roller (13) further passes by the first guide sensor (301), which then detect it and energizes the cylinder (221) to move forwardly the auxiliary roller (223), with the result that the auxiliary roller (223) collides against the second guide roller (12) and pushes the same in a direction along the third arcuate groove area (22C). Namely, the second guide roller (12) is given an additional force enough to turn at the most acutely curved point, and smoothly passes therethrough for further following along the third guide groove area (22C). Also, at this moment, the sensor (403) is turned "on" by that third guide roller (13), which results in the auxiliary guide device (3A) being operated to to bring its roller (3A-1) to contact with the second cover material through the opening (3A-2*a*) so as to upturn that particular second cover material (7) from the sewing line between it and the first cover material (4) along the first curved corner portion (42) of the latter (see the phantom lines in FIGS. 15, 16 and 17).

The slow down time of the sewing machine (M) caused by the deceleration microswitch (401) is preset in the control section (M1) for an appropriate time period that allows the sewing mcahine (M) to sew most of both first curved corner portions of first and second cover materials (4)(7), so that after lapse of such time, the sewing or feeding speed of sewing machine (M) is returned to the previous normal one. Though not shown, this process may be programmed, using a known computerized electric circuitry in the control section (M1).

Figure 15:
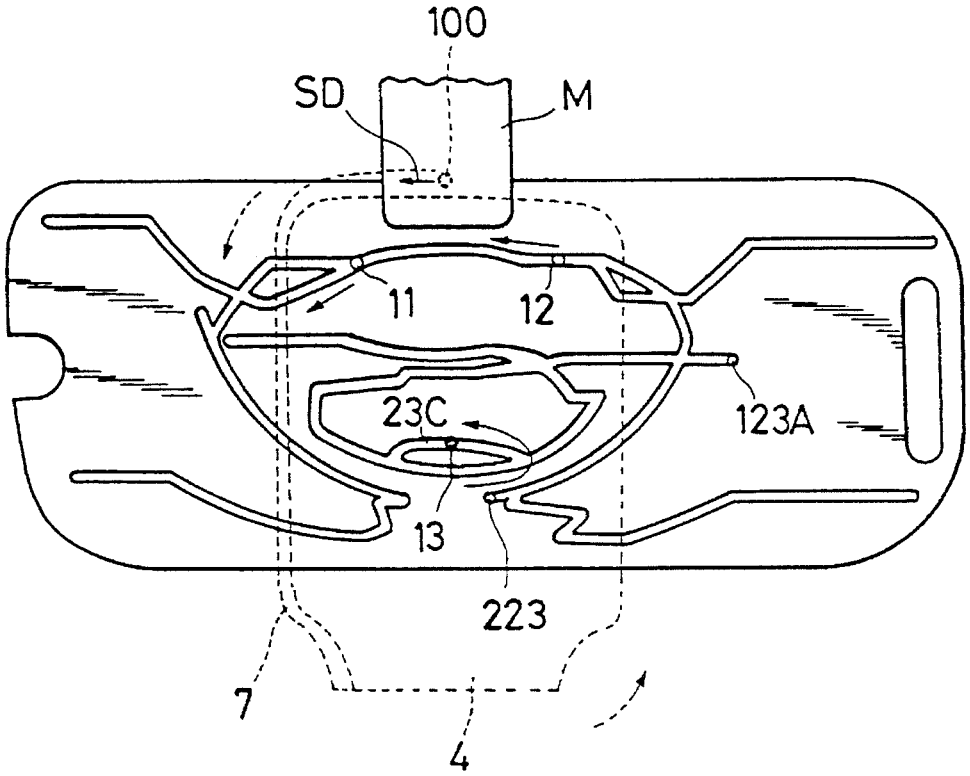
FIG. 15 is a diagram showing the displacements of both movable guide plate and three guide rollers for sewing a forward side of the two cover materials.

FIG. 15 shows the state where the first curved corner portion (42) of first cover material (4) has been sewn with the corresponding curved corner portion of second cover material (7) and the forward rectilinear end portion of the same cover material (4) is being sewn with the corresponding end portion of second one (7). Up to this sewing stage, though not shown clearly but as understandable from the solid-line and dot-line arrows in both FIGS. 14 and 15, the second guide roller (12) has passed along or followed its corresponding third and fourth curved groove areas (22C)(22D), while the second guide roller (12) has followed the left-side end and central parts of second elliptical groove area (23B) as well as the midway in the third curved (or generally inverted-U-shaped) groove area (23C) (see FIG. 15). During this stage, the first guide roller (11), by contrast, is almost stopped at the midway of generally straight groove area (21C) which corresponds to the sewing needle (100). In other words, because of the two non-acutely arcuate guiding passages defined respectively by those particular groove areas (22C)(23B), and further because of the center of the first guide roller (11) being positioned adjacent to and in correspondence with the axis of sewing needle (100), the points to be applied greater by the feeding force of sewing machine (M) in such equilateral-triangle guide roller arrangement are the second and third guide rollers (12)(13) than the first guide roller (11). This allows the first guide roller (11) to be substantially retained against movement at the center of a circular along which the curved corner portion (42) of first cover material (4) extends, while at the same time allowing the second and third guide rollers (12)(13) to be displaced in an arcuate way with respect to that first guide roller (11), which effectively insures to orient the first and second cover materials (4)(7) towards the sewing needle (100) in the tangential direction thereof to complete sewing them together along the curvature of their common corner portions (i.e. at (42)). The same goes for the case of sewing the corner portion (42) of one first cover material (4) only. It is also observed that the second cover material (7) is upturned from the peripheral sides of first cover material (4) during the sewing operation.

Figure 16:
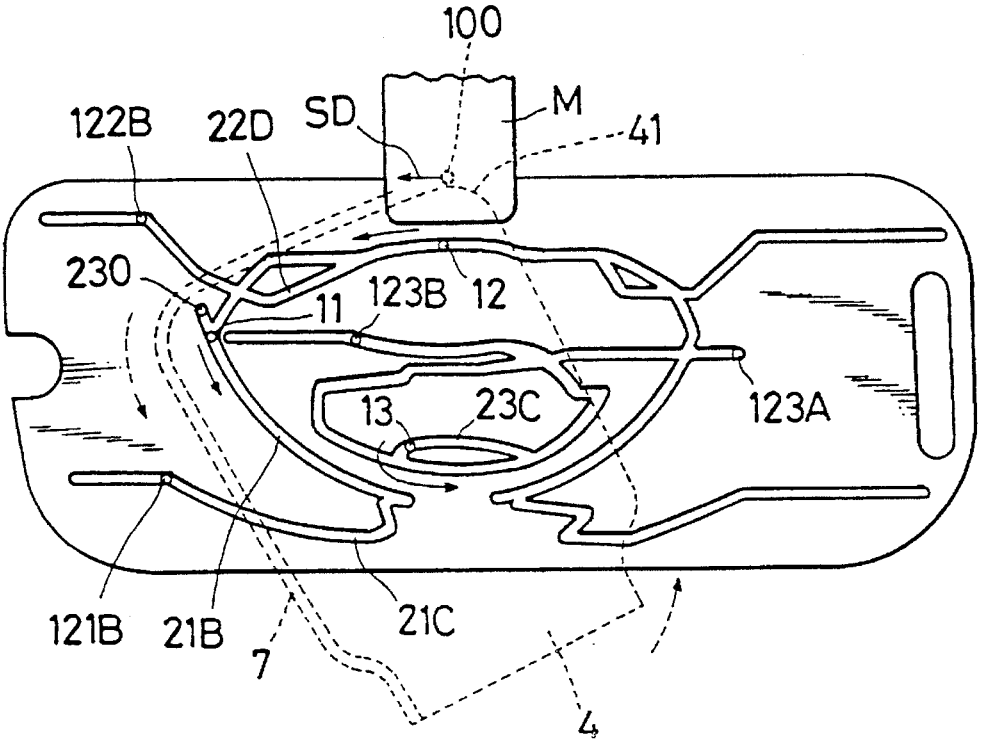
FIG. 16 is a diagram showing the displacements of both movable guide plate and three guide rollers for sewing another curved corner portion of the two cover materials.

FIG. 16 shows the state where the second cover material (7) is about to be sewn along another curved corner portion (41) of first cover material (4). At this point, the second guide roller (12) follows the generally straight third groove (21C), while the first guide roller (11) is positioned at another most acutely curved point or juncture between the forth and fifth arcuate groove areas (22D)(22E), i.e. the point where the roller (11) is most difficult to turn or change its direction. But, as the third guide roller (13) passes along the left-side juncture between the second and third groove areas (23B)(23C) (as viewed from the FIG. 16), the second deceleration microswitch (402) located there (see FIG. 8) is turned "on" by that guide roller (13) to decrease the sewing or feeding speed of sewing machine (M), thus allowing the first guide roller (11) to slowly enter the fifth groove area (22E) from the fourth groove area (22D), soon after which, the third guide sensor (302), which is located generally at the central part of the second elliptical second groove area (23B) (23B) in the proximity of that deceleration microswitch (402), detects the third guide roller (13) and energizes the cylinder (221) to move forwardly the auxiliary guide roller (230). As a result, the auxiliary roller (230) collides against and pushes the first guide roller (11) in a direction along the fifth groove area (21E), thus giving the roller (11) an additional force enough to turn at the most acutely curved point and allowing it to pass smoothly therethrough for further following along the fifth groove area (21E). Although not clearly shown, but as understandable from the solid-line and dot-line arrows in FIG. 16, as similar to the above-explained turning motions in FIG. 14, the second guide roller (12) is substantially retained against movement at the midway of generally straight groove area (21C) corresponding to the sewing needle (100), i.e. the center of a circle along which the second curved corner portion (41) extends, while on the other hand, the first guide roller (11) follows the fourth and fifth groove areas (21D)(21E) and the third guide roller (13) follows the third groove area (23C) and the remaining passage of the second groove area (23B), as indicated by the arrow in FIG. 6 and arrow (④) in FIG. 13. Namely, the first and third guide rollers (12)(13) are displaced in an arcuate way relative to the second guide roller (12), and because of the second guide roller (12) being at the center of a circle along which the second curved corner portion (42) of first cover material (4) extends, such particular turning motions of the former two rollers (11)(13) about the substantially suspended latter roller (12) insures to cause both cover materials (4)(7) to be sewn together along the curvature of their common corner portions (i.e. at (41)) by the sewing machine (M).

Figure 17:
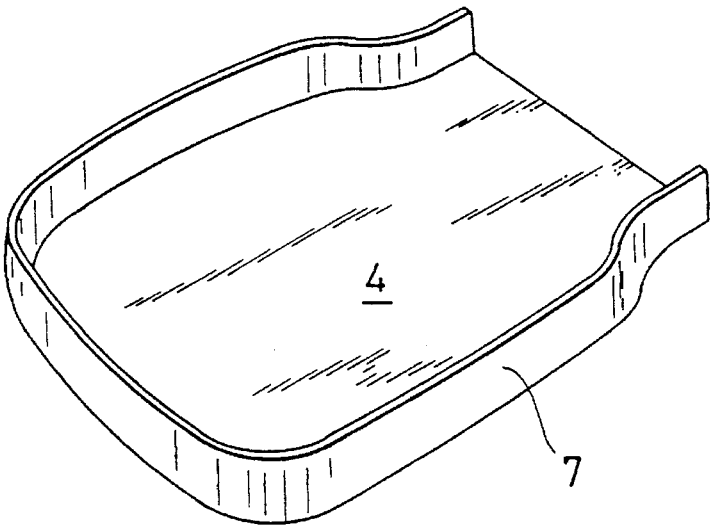
FIG. 17 is a schematic perspective of a trim cover assembly produced by the automated sewing device.

Thereafter, although not shown but as understandable from FIGS. 11, 12, 13 and 16, the first guide roller (11) follows the sixth curved groove area (21F) to reach the end point (121B) as indicated by the arrow (③) in FIG. 11, the second guide roller (12) follows the fifth curved groove area (22E) to reach the end point (122B) as indicated by the arrow (③) in FIG. 12, and the third guide roller (13) follows the remaining part (generally straight part) continuous from the second circular groove area (23B) to reach the end point (123B) as indicated by the arrow (④) in FIG. 13, so as to complete sewing together the another lateral side of the both first and second cover materials (4)(7). Though not shown, the three end points (121B)(122B)(123B) are each provided with a microswitch connected electrically with the control section (M1). Thus, upon all those three guide rollers (11)(12)(13) reaching their end points (121B)(122B)(123B), the microswitch is turned "on" to send a signal to the control section (M1) which discontinues the supply of current to the sewing machine (M), whereupon the sewing machine (M) and auxiliary guide device (3A) are stopped to finalize the sewing of the first and second cover materials (4)(7) at their respective predetermined sewing end points (40B)(70B). Consequently, the first cover material (4) with the second cover material (7) erected from and along the three sides thereof is produced, and should be removed from the movable guide plate (1). (In this respect, again, the same processes may be executed in the case of sewing only one first cover material (4).) Then, the upturned second cover material (7), which shows its reverse side outwardly along the three peripheral sides of the first cover material (4), is turned over relative to that first one (4) so as to produce such three-dimensional trim cover assembly as shown in FIG. 17.

It is noted that the second slow down time of sewing machine (M) caused by the second deceleration microswitch (402) is also preset as likewise in the first one (401) mentioned above, so that the sewing machine (M) may be worked slowly during the step of sewing the second corner portion (41) of first material and after lapse of the preset time, its sewing or feeding speed be returned to the normal faster speed.

The illustrated guide groove pattern formed on the guide base plate (2) is adapted to cause the above-described displacements of movable guide plate (1) for sewing the generally U-shaped three peripheral sides of first cover material (4) or of both first and second cover materials (4)(7) which is of the type including such four curved corner portions (sl, 41, 42), and strictly stated, the whole peripheral U-shaped three sides thereof is slightly close to a circular shape. However, the generic technical concept of the present invention resides in using the above-elaborated equilateral-triangular guide roller arrangement to attain the sewing of such generally U-shaped cover material, be it one or two cover materials, which includes two curved corner portions. Hence, the guide groove pattern of guide base plate (2) per se may be modified slightly from the illustrated one, depending on minor partial changes of seat design, but even in that case, the basic formation of generally straight guide groove areas (e.g. 21A, 22A, . . . ) and generally dual circular or elliptical guide groove areas (e.g. 22C, 21C, 21E and 23B, 23C . . . ) is a basic criteria for forming a specific shape of whole guide groove pattern, depending on a minor partial design of either one or two cover materials. For instance, if the first and second cover materials (4)(7) are not formed with such minor curved portions (at sl), the curved groove areas (21B, 22B, 21F, 22E) are not defined in the whole groove pattern, while the third guide groove (23) shows more smooth elliptical configuration in its second groove area (23B), so that more simple straight and curved or circular basic groove formation may be formed than the illustrated one.

Further, in the illustrated embodiments, preferably, during the foregoing sewing operations, the decorative beading may be sewn together with the first and second cover materials (4)(7) by operation of the previously stated device (5, 6) for fixing a decorative beading, so that the beading extends integrally along the sewn line between both cover materials (4)(7) for improvement of aesthetic appearance of resulting trim cover assembly.

While having described the present invention thus far, it should be understood that the invention is not limited to the illustrated embodiments, but other various modifications, replacements and additions may be structurally applied thereto without departing from the scopes of the appended claims.

What is claimed is:

1. An automated sewing device for sewing a base material with a pair of first and second curved corner portions formed in at least one side thereof, each having a same radius of curvature, said automated sewing device comprising:

a sewing machine including a sewing needle and a feeding member;

a movable guide means having a shape generally similar to that of said base material, upon which movable guide means, said base material is to be secured;

said movable guide means being provided, on a reverse side thereof, with a first guide roller, a second guide roller and a third guide roller, in such a manner that said first and second guide rollers are respectively disposed at one point corresponding to a center of curvature of said first curved corner portion of said base material and at another point corresponding to a center of curvature of said second curved corner portion of the same base material, and further that all said first, second and third guide rollers are disposed at three apexes of an equilateral triangle, respectively;

a base guide plate means in which a plurality of guide grooves are formed in such a pattern that describes three loci respectively of said first, second and third guide rollers required to cause proper displacements of said movable guide means for guiding said at least one side of said base material including said first and second curved corner portions in a direction to said sewing needle of said sewing machine, wherein, upon said base guide plate means, said movable guide means is movably mounted, with said first, second and third guide rollers being slidably fitted in said plurality of guide grooves, wherein said at least one side of the base material secured on the movable guide means is automatically fed and sewn by said sewing machine, with said movable guide means being displaced under guidance of said first, second and third guide rollers which follow the respective said three loci.

2. The automated sewing device according to claim 1, wherein said plurality of guide grooves include one acutely curved groove portion where said first guide roller resists a change in direction thereof, and another acutely curved groove portion where said second guide roller resists a change in direction thereof, and wherein a first auxiliary guide roller means is provided to facilitate directional change of said first guide roller along said one acutely curved groove portion, and a second auxiliary guide roller means is provided to facilitate directional change of said second guide roller along said another acutely curved groove portion.

3. The automated sewing device according to claim 2, wherein each of said first and second auxiliary guide roller means comprises a guide slit defined along a part of either of said one and another acutely curved groove portions, an auxiliary guide roller slidably fitted in said guide slit, and a cylinder connected to said auxiliary guide roller, and wherein operation of said cylinder causes said auxiliary guide roller to move along said guide slit, pushing each of said first and second guide rollers to facilitate directional change thereof at the corresponding one of said one and another acutely curved groove portions.

4. The automated sewing device according to claim 3, wherein a sensor means is provided in association with each of said first and second auxiliary guide roller means, said sensor means being disposed at a portion of said guide grooves which said third guide roller follows, at a point of time when one of said first and second rollers reaches the corresponding one of said one and another acutely curved groove portions, so that said sensor means may detect said third guide roller to actuate one of said first and second auxiliary guide roller means.

5. The automated sewing device according to claim 1, wherein a speed control means is provided for decreasing a sewing or feeding speed of said sewing machine, only during a time when one of said first and second rollers change its direction at a corresponding acutely curved groove portion in said guide grooves where said one of said first and second rollers resists a change in its direction thereof.

6. The automated sewing device according to claim 5, wherein a switch means is provided in association with said speed control means, said switch means being disposed at a portion of said guide grooves which said third guide roller follows at a point of time when one of said first and second rollers reaches the corresponding acutely curved groove portion, so that said switch means may be turned on by said third guide roller to decrease said sewing or feeding speed of said sewing machine.

7. The automated sewing device according to claim 1, wherein said plurality of guide grooves include generally straight groove areas, curved groove areas and generally circular groove areas, which are formed in conformity with said three loci respectively of said first, second and third guide rollers required to cause said proper displacements of said movable guide means for guiding said at least one side of said base material including said first and second curved corner portions in a direction to said sewing needle of said sewing machine, such that said first, second and third guide rollers may follow said generally straight groove areas to cause a generally straight side portion of said base material to be sewn by said sewing needle along a sewing direction thereof, and then one of said first and second guide rollers may follow said curved groove areas in cooperation with said third guide roller following said generally circular groove areas so as to cause one of said first and second curved corner portions of said base material to be sewn by said sewing needle along a curvature thereof, after which, another of said first and second guide rollers may follow said curved groove areas in cooperation with said third guide roller following said generally circular groove areas so as to cause another of said first and second corner portions of said base mateial to be sewn by said sewing needle along a curvature thereof.

8. The automated sewing device according to claim 7, wherein both said curved and generally circular groove areas are defined centrally of said movable guide means, such that said circular groove areas are disposed inwardly of said curved groove areas, and said straight groove areas are defined on opposite sides of those curved and generally circular groove areas, so that said first, second and third guide rollers may follow said straight groove areas along their respective loci to cause sewing of said generally straight side portion of said base material, at each of sewing start and sewing end points on said movable guide means, and that said first and second guide rollers may follow said curved groove areas along their respective said loci, while said third guide roller may follow said generally circular groove areas along the locus thereof, without interference among those three guide rollers, to cause each of said first and second curved corner portions of said base material to be sewn along the curvature thereof by said sewing needle.

9. The automated sewing device according to claim 8, wherein said generally straight groove areas include a common groove portion disposed near said sewing needle, while said curved groove areas include first and second curved groove portions which are distant from said sewing needle and disposed generally in a symmetrical relation with each other relative to said sewing needle, an arrangement of those common, first and second curved groove portions being such that when sewing said first curved corner portion of said base material, said second and third guide rollers are displaced in a generally arcuate way with respect to said first guide roller being positioned at said common groove portion, thereby causing said first curved corner portion to be sewn by said sewing needle in a direction of tangent touching on the curvature of said first curved corner portion, and that when sewing said second curved corner portion of said base material, said first and third guide rollers are also displaced in a generally arcuate way with respect to said second guide roller being positioned at said common groove portion, thereby causing said second curved corner portion to be sewn by said sewing needle in a direction of a tangent touching on the curvature of the said second curved corner portion.

10. The automated sewing device according to claim 1, wherein said movable guide means is provided, at an upper surface thereof, with a securing means for locating and removably securing said base material upon said movable guide means, and wherein said securing means comprises a peripheral securing element disposed along a peripheral side of said movable guide means, and a securing needle disposed generally centrally of said movable guide means.

11. The automated sewing device according to claim 1, wherein said peripheral securing element comprises a plurality of needle cloths and a velvet-type fastener type for removably securing peripheral end portions of said base material on said movable guide means.

12. The automated sewing device according to claim 1, wherein said movable guide means is a movable guide plate formed in a shape generally similar to that of said base material, which is provided, at a reverse surface thereof, with said first, second and third guide rollers, and further provided, at an upper surface thereof, with a securing means for securing said base material thereon, said movable guide plate having at least one side which includes two curved corner portions generally similar to those of said at least one side of said base material, wherein said at least one side of said base material is to be located and secured on said at least one side of said movable guide plate via said securing means, and wherein said base guide plate means includes a location wall erected at one end side thereof, said location wall being formed in a shape generally similar to said at least one side of said movable guide plate, so that said said movable guide plate may be set on said base guide plate in reference to said location wall and thereafter, said base material may be precisely located in a given position upon said base guide plate by bringing said at least one side of said base material to contact and alignment with said location wall.

13. The automated sewing device according to claim 12, wherein said base guide groove is formed with three additional grooves each terminating in a setting end in which each of said first, second and third guide rollers is to be fitted, respectively, in order to insure location of said movable guide plate in reference to said location wall.

14. The automated sewing device according to claim 12, wherein said base guide plate means includes a cut-away portion at said one end side thereof, said cut-away portion being formed in both said base guide plate means and location wall, and being adapted to make accessible an operator's hand therethrough to said movable guide plate which is set on said base guide plate in reference to said location wall.

15. The automated sewing device according to claim 1, wherein a stationary guide plate is provided above said movable guide means, so that another base material may be introduced on said stationary guide plate towards said sewing machine, and then a part of said another base material may be sewn with and along said at least one side of said first base material which is secured on said movable guide means.

16. The automated sewing device according to claim 15, wherein said stationary guide plate has an auxiliary guide device provided therewith, and wherein said auxiliary guide device is operable to upturn said part of said another base material from said first base material during sewing operation of said sewing machine.

17. The automated sewing device according to claim 1, wherein said base material is of a three-layer lamination type comprising a top cover layer, a foam padding layer and a back cloth in this order.

* * * * *